US011705034B2

(12) United States Patent
Xi

(10) Patent No.: US 11,705,034 B2
(45) Date of Patent: Jul. 18, 2023

(54) GOA CIRCUIT AND DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventor: Suping Xi, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 500 days.

(21) Appl. No.: 16/970,927

(22) PCT Filed: Jun. 4, 2020

(86) PCT No.: PCT/CN2020/094292
§ 371 (c)(1),
(2) Date: Aug. 18, 2020

(87) PCT Pub. No.: WO2021/203544
PCT Pub. Date: Oct. 14, 2021

(65) Prior Publication Data

US 2023/0100545 A1 Mar. 30, 2023

(30) Foreign Application Priority Data

Apr. 10, 2020 (CN) ..... 202010277373.9

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01); *G09G 2310/08* (2013.01)

(58) Field of Classification Search
CPC ..... G09G 3/20; G09G 2300/0408; G09G 2310/0267; G09G 2310/08
See application file for complete search history.

(56) References Cited

U.S. PATENT DOCUMENTS

2017/0102805 A1* 4/2017 Xiao ..... G06F 3/0412
2018/0046308 A1* 2/2018 Xiao ..... G09G 3/20
2020/0133327 A1* 4/2020 Lee ..... G11C 19/28
(Continued)

FOREIGN PATENT DOCUMENTS

CN 1868003 A 11/2006
CN 101477836 A 7/2009
CN 104252851 A 12/2014
(Continued)

*Primary Examiner* — Sejoon Ahn
(74) *Attorney, Agent, or Firm* — PV IP PC; Wei Te Chung; Zhigang Ma

(57) ABSTRACT

A gate driver on array (GOA) circuit and a display panel are provided. The GOA circuit includes a plurality of cascaded GOA units. The GOA units include a first GOA unit and a second GOA unit. By setting a virtual reset module in the second GOA unit, and the virtual reset module corresponding to the reset module in the first GOA unit, a difference between the first GOA unit and the second GOA unit is reduced and stability of the GOA circuit is improved.

16 Claims, 4 Drawing Sheets

(56) References Cited

U.S. PATENT DOCUMENTS

2020/0135100 A1* 4/2020 Park ..... G09G 3/3233

FOREIGN PATENT DOCUMENTS

| | | | |
|---|---|---|---|
| CN | 106128352 | A | 11/2016 |
| CN | 106683606 | A | 5/2017 |
| CN | 106935179 | A | 7/2017 |
| CN | 108010496 | A | 5/2018 |
| CN | 108962171 | A | 12/2018 |
| CN | 109036325 | A | 12/2018 |
| CN | 109064961 | A | 12/2018 |
| CN | 109192165 | A | 1/2019 |
| CN | 109584809 | A | 4/2019 |
| CN | 110085183 | A | 8/2019 |
| EP | 0324456 | A2 | 7/1989 |
| KR | 20180076236 | A | 7/2018 |

* cited by examiner

GOA CIRCUIT AND DISPLAY PANEL

RELATED APPLICATIONS

This application is a Notional Phase of PCT Patent Application No. PCT/CN2020/094292 having international filing date of Jun. 4, 2020, which claims the benefit of priority of Chinese Patent Application No. 202010277373.9 filed on Apr. 10, 2020. The contents of the above applications are all incorporated by reference as if fully set forth herein in their entirety.

FIELD OF INVENTION

The present invention relates to the field of electronic technologies, and more particularly to a gate driver on array (GOA) circuit and a display panel.

BACKGROUND OF INVENTION

Array substrate gate driver technology (date driver on array, GOA for short) is a driving method that integrates a gate driver circuit on an array substrate of a display panel to realize progressive scanning. Therefore, a gate driver circuit portion can be omitted. GOA has advantages of reducing production costs and realizing a narrow bezel design of the display panel and is used by various displays. A structure of the GOA circuit in the prior art is complicated, signal lines are numerous and densely arranged, therefore, a requirement for stability of the GOA circuit is very high. A difference in structure or thin film transistor (TFT) process between different GOA units in the GOA circuit will reduce stability of the GOA circuit.

Technical Problem

In the prior art, a difference in structure or thin film transistor (TFT) process between different GOA units in the GOA circuit will reduce stability of the GOA circuit.

SUMMARY OF INVENTION

An embodiment of the present application provides a gate driver on array (GOA) circuit and a display panel to solve a technical problem that there are differences between GOA units at various stages in the GOA circuit, thereby reducing stability of the GOA circuit.

An embodiment of the present application provides a GOA circuit comprising a plurality of cascaded GOA units, the GOA units comprise a first GOA unit and a second GOA unit, the first GOA unit and the second GOA unit are both provided with a first node; the first GOA unit comprises a reset module, the reset module is connected to a low-potential signal and a control signal and is electrically connected to the first node, and the reset module is configured to pull down a potential of the first node to a potential of the low-potential signal under control of the control signal; the second GOA unit comprises a virtual reset module corresponding to the reset module, and the virtual reset module is configured to reduce a difference between the first GOA unit and the second GOA unit.

In the GOA circuit provided by an embodiment of the present application, the reset module comprises a transistor, a gate of the transistor is electrically connected to the control signal, a source of the transistor is electrically connected to the low-potential signal, and a drain of the transistor is electrically connected to the first node; the virtual reset module comprises a virtual transistor, and the virtual transistor is disposed corresponding to the transistor.

In the GOA circuit provided by an embodiment of the present application, no active layer is provided in the virtual transistor.

In the GOA circuit provided by an embodiment of the present application, a gate of the virtual transistor is electrically connected to the control signal, a source of the virtual transistor is electrically connected to the low-potential signal, and a drain of the virtual transistor is electrically connected to the first node.

In the GOA circuit provided by an embodiment of the present application, at least one electrode is unloaded among a source, a drain, and a gate of the virtual transistor.

In the GOA circuit provided by an embodiment of the present application, the transistor and the virtual transistor are a same type of transistor.

In the GOA circuit provided by an embodiment of the present application, the transistor in the GOA circuit is a low temperature polysilicon thin film transistor, an oxide semiconductor thin film transistor, or an amorphous silicon thin film transistor.

In the GOA circuit provided by an embodiment of the present application, the virtual transistor and the transistor are made by a same process.

In the GOA circuit provided by an embodiment of the present application, the second GOA unit is connected to a start signal, and the start signal and the control signal are a same signal.

Accordingly, an embodiment of the present application further comprises a display panel comprising a GOA circuit, the GOA circuit comprises a plurality of cascaded GOA units, the GOA units comprise a first GOA unit and a second GOA unit, the first GOA unit and the second GOA unit are both provided with a first node; the first GOA unit comprises a reset module, the reset module is connected to a low-potential signal and a control signal and is electrically connected to the first node, and the reset module is configured to pull down a potential of the first node to a potential of the low-potential signal under control of the control signal; the second GOA unit comprises a virtual reset module corresponding to the reset module, and the virtual reset module is configured to reduce a difference between the first GOA unit and the second GOA unit.

In the display panel provided by an embodiment of the present application, the reset module comprises a transistor, a gate of the transistor is electrically connected to the control signal, a source of the transistor is electrically connected to the low-potential signal, and a drain of the transistor is electrically connected to the first node; the virtual reset module comprises a virtual transistor, and the virtual transistor is disposed corresponding to the transistor.

In the display panel provided by an embodiment of the present application, no active layer is provided in the virtual transistor.

In the display panel provided by an embodiment of the present application, a gate of the virtual transistor is electrically connected to the control signal, a source of the virtual transistor is electrically connected to the low-potential signal, and a drain of the virtual transistor is electrically connected to the first node.

In the display panel provided by an embodiment of the present application, at least one electrode is unloaded among a source, a drain, and a gate of the virtual transistor.

In the display panel provided by an embodiment of the present application, the transistor and the virtual transistor are a same type of transistor.

In the display panel provided by an embodiment of the present application, the transistor in the GOA circuit is a low temperature polysilicon thin film transistor, an oxide semiconductor thin film transistor, or an amorphous silicon thin film transistor.

In the display panel provided by an embodiment of the present application, the virtual transistor and the transistor are made by a same process.

In the display panel provided by an embodiment of the present application, the second GOA unit is connected to a start signal, and the start signal and the control signal are a same signal.

Beneficial Effect

An embodiment of the present application provides a GOA circuit and a display panel. The GOA circuit includes a plurality of cascaded GOA units. The GOA units include a first GOA unit and a second GOA unit. By setting a virtual reset module in the second GOA unit, and the virtual reset module corresponding to the reset module in the first GOA unit, a difference between the first GOA unit and the second GOA unit is reduced and stability of the GOA circuit is improved.

DESCRIPTION OF DRAWINGS

In order to more clearly explain technical solutions in embodiments of the present application, drawings required in the description of the embodiments will be briefly introduced below. Obviously, the drawings in the following description are only some embodiments of the present application. For those skilled in the art, without paying any creative work, other drawings can also be obtained based on these drawings.

DETAILED DESCRIPTION OF PREFERRED EMBODIMENTS

Figure 1:
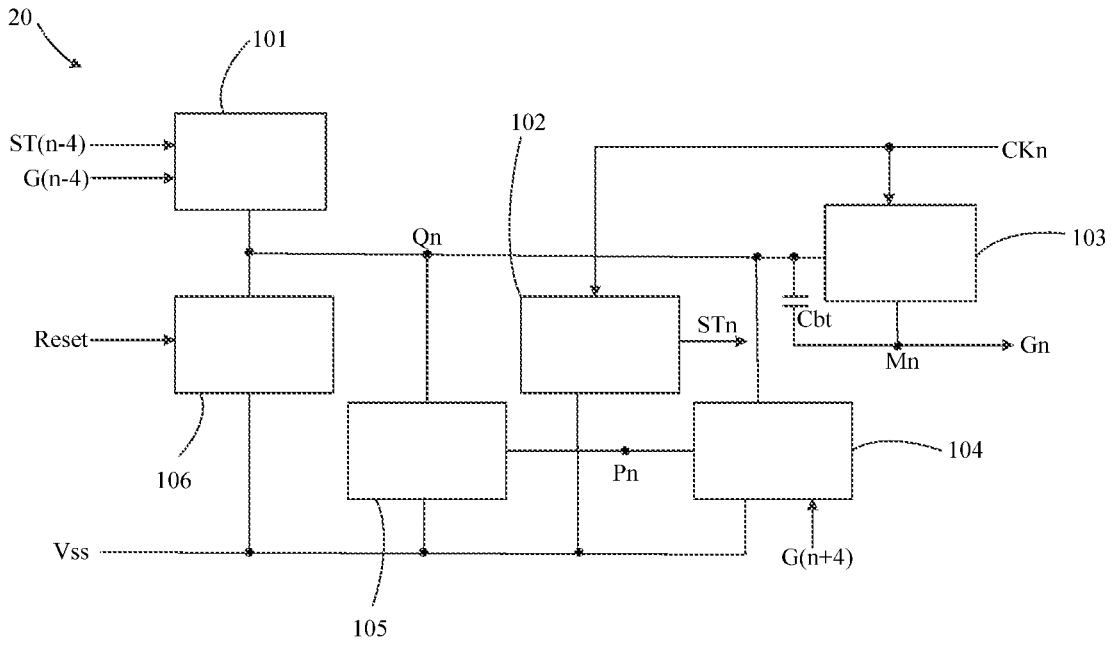
FIG. 1 is a first schematic structural diagram of a first GOA unit in a GOA circuit provided by an embodiment of the present application.

The technical solutions in the embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by those skilled in the art without making creative work fall within the protection scope of the present application.

In the description of the present application, it should be understood that the terms "first" and "second" are used for description purposes only and cannot be understood as indicating or implying relative importance or implicitly indicating the number of technical features indicated. Thus, features defined as "first", "second", etc. may explicitly or implicitly include one or more of the features described above, and therefore cannot be construed as limiting the present application.

Transistors used in all the embodiments of the present application may be thin film transistors, field effect transistors, or other devices with the same characteristics. Since a source and a drain of the transistor used here are symmetrical, the source and the drain are interchangeable. In an embodiment of the present application, in order to distinguish the two electrodes of the transistor except a gate, one of the electrodes is called the source, and the other electrode is called the drain. According to the form in the drawing, a middle terminal of a switching transistor is a gate, a signal input terminal is a drain, and an output terminal is a source. In addition, the transistors used in the embodiments of the present application may include two types of P-type transistors and/or N-type transistors. The P-type transistor is turned on when the gate is at a low potential and is turned off when the gate is at a high potential. The N-type transistor is turned on when the gate is at a high potential and is turned off when the gate is at a low potential.

In addition, the embodiments of the present application are introduced with 8CK signal GOA circuits, but the principles of the present application are also applicable to multi-CK signal GOA circuits such as 2CK, 4CK, and 6CK. Therefore, the introduction of the embodiments in the present application cannot be understood as a limitation to the present application.

Figure 2:
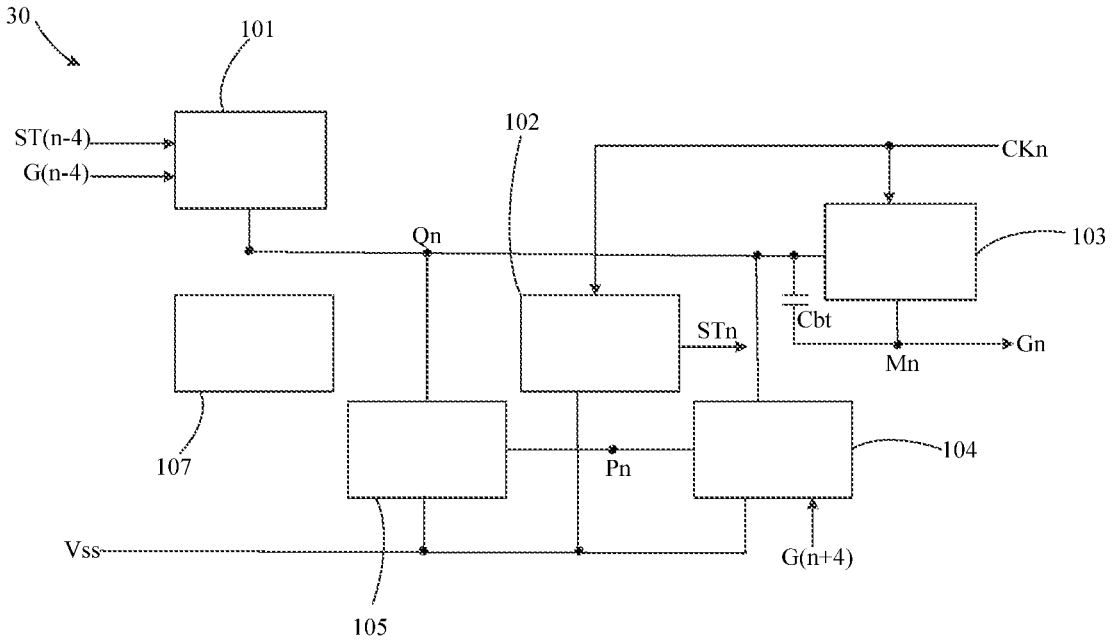
FIG. 2 is a first schematic structural diagram of a second GOA unit in a GOA circuit provided by an embodiment of the present application.

The GOA circuit provided by an embodiment of the present application includes a multi-stage cascaded GOA unit, and the GOA unit includes a first GOA unit and a second GOA unit. Referring to FIG. 1 and FIG. 2, FIG. 1 is a first schematic structural diagram of a first GOA unit 20 in a GOA circuit provided by an embodiment of the present application, and FIG. 2 is a schematic diagram of a first structure of a second GOA unit 30 in a GOA circuit provided by an embodiment of the present application. As shown in FIG. 1 and FIG. 2, both the first GOA unit 20 and the second GOA unit 30 are provided with a first node Qn. The first GOA unit 20 includes a reset module 106. The reset module 106 is connected to a low-potential signal Vss and a control signal Reset, and is electrically connected to the first node Qn. The reset module 106 is configured to pull down a potential of the first node Qn to a potential of the low-potential signal Vss under control of the control signal Reset. The second GOA unit 30 includes a virtual reset module 107. The virtual reset module 107 and the reset module 106 are correspondingly disposed, and the virtual reset module 107 is configured to reduce a difference between the first GOA unit 20 and the second GOA unit 30.

Corresponding setting of the virtual reset module 107 and the reset module 106 means that positions of the virtual reset module 107 and the reset module 106 in the corresponding GOA units are kept the same, so as to improve structural consistency of the first GOA unit and the second GOA unit.

In addition, the reset module 106 in the first GOA unit 20 is configured to pull down the potential of the first node Qn to the potential of the low-potential signal Vss under the control of the control signal Reset. However, the virtual reset module 107 does not transmit any signal in the second GOA unit 30. For specific settings, referring to FIG. 2, the virtual reset module 107 may be disconnected from signals such as the control signal Reset, the first node Qn, or the low-potential signal Vss, so that the virtual reset module 107 does not perform signal transmission.

In some embodiments, specific devices in the virtual reset module 107 may also be kept in a state of not participating in signal transmission, which is not specifically set in this embodiment of the present application.

An embodiment of the present application provides a GOA circuit. The GOA circuit includes multiple GOA units arranged in cascade. The GOA unit includes a first GOA unit 20 and a second GOA unit 30. By setting a virtual reset module 107 that does not perform signal transmission in the second GOA unit 30, and the virtual reset module 107 is correspondingly set to the reset module 106 in the first GOA unit, thereby reducing a difference between the first GOA unit and the second GOA unit and improving stability of the GOA circuit.

In an embodiment of the present application, the first GOA unit 20 and the second GOA unit 30 each include a pull-up control module 101, a download module 102, a pull-up module 103, a pull-down module 104, a pull-down maintenance module 105, and a bootstrap capacitor Cbt.

The pull-up control module 101 accesses a n−4th stage transmission signal ST(n−4) and a n−4th stage scanning signal G(n−4), and is electrically connected to a first node Qn for pull-up a potential of the first node Qn. The download module 102 is connected to a low-potential signal Vss and a clock signal CKn, and is used to output a current stage transmission signal Gn. The pull-up module 103 is connected to the clock signal CKn and is electrically connected to the first node Qn and a second node M for outputting a current stage scan signal Gn. The pull-down module 104 is connected to the low-potential Vss and a n+4th-stage scan signal G(n+4), and is electrically connected to the first node Qn, the second node M, and a third node P for pulling down potentials of the first node Qn and the current stage scan signal Gn. The pull-down maintenance module 105 accesses the low-potential signal Vss and is electrically connected to the first node Qn and the third node P, and is used to maintain the potential of the first node Qn to the potential of the low-potential signal Vss after the pull-down module 104 pulls down the potential of the first node Qn. A first end of the bootstrap capacitor Cbt is electrically connected to the first node Qn, and a second end of the bootstrap capacitor is electrically connected to the second node M.

In addition, the first GOA unit 20 also includes a reset module 106. The reset module 106 is connected to the low-potential signal Vss and the control signal Reset, and is electrically connected to the first node Qn. The reset module 106 is used to further pull down the potential of the first node Qn to the potential of the low-potential signal Vss under the control of the control signal Reset. The virtual reset module 107 is provided in the second GOA unit 30. The virtual reset module 107 and the reset module 106 are set correspondingly, but no signal is transmitted in the second GOA unit 30.

Figure 3:
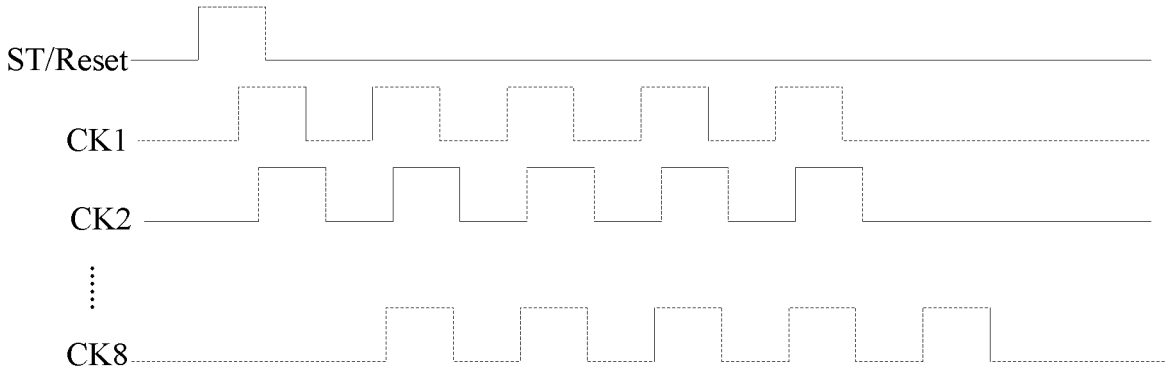
FIG. 3 is a signal timing diagram of an 8CK signal GOA circuit provided by an embodiment of the present application.

It can be understood that, as shown in FIG. 1 and FIG. 2, the pull-up control module 101 accesses the n−4th stage transmission signal ST(n−4) and the n−4th stage scan signal G(n−4), and is electrically connected to the first node Qn and used to pull up the potential of the first node Qn. However, in the first four stages of the GOA unit of the GOA circuit, the n−4th stage transmission signal ST(n−4) and the n−4th stage scan signal G(n−4) cannot be provided. Therefore, as shown in FIG. 3, in an embodiment of the present application, the second GOA unit 30 (the first four-stage GOA unit) accesses a start signal ST. Since the start signal ST and the control signal Reset are the same signal, the second GOA unit 30 is provided with a virtual reset module 107 that does not perform signal transmission, to avoid pulling up the potential of the first node Qn when the pull-up control module 101 pulls up, and the virtual reset module 107 pulls down the potential of the first node Qn while reducing the difference between the first GOA unit 20 and the second GOA unit 30.

In addition, in some embodiments, for example, in the 8CK signal GOA circuit, referring to FIG. 3, due to the setting of the clock signals CK1-CK8, the eight GOA units are one stage transfer cycle. Therefore, usually the first eight stages of GOA units (the second GOA units 30) will be provided with a virtual reset module 107.

It should be noted that the GOA circuit structure provided by the embodiments of the present application is only to better understand the principle of the present application and cannot be understood as a limitation to the present application. In addition, the specific circuit connections in the above-mentioned pull-up control module 101, download module 102, pull-up module 103, pull-down module 104, and pull-down maintenance module 105 can be set according to actual needs, which is not specifically limited in this application.

Figure 4:
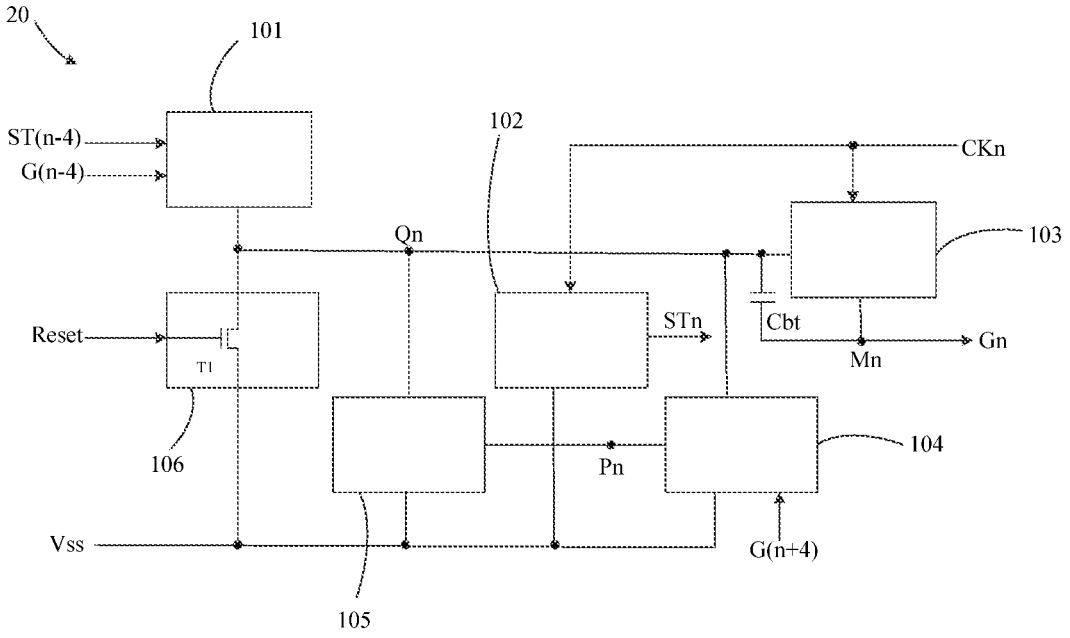
FIG. 4 is a second schematic structural diagram of a first GOA unit in a GOA circuit provided by an embodiment of the present application.

Referring to FIG. 4, FIG. 4 is a second schematic structural diagram of a first GOA unit in a GOA circuit provided by an embodiment of the present application. The reset module 106 includes a transistor T1. A gate of the transistor T1 is electrically connected to the control signal Reset. A source of the transistor T1 is electrically connected to the low-potential signal Vss. A drain of the transistor T1 is electrically connected to the first node Qn. The transistor T1 is configured to further pull down the potential of the first node Qn to the potential of the low-potential signal Vss under control of the control signal Reset.

Figure 5:
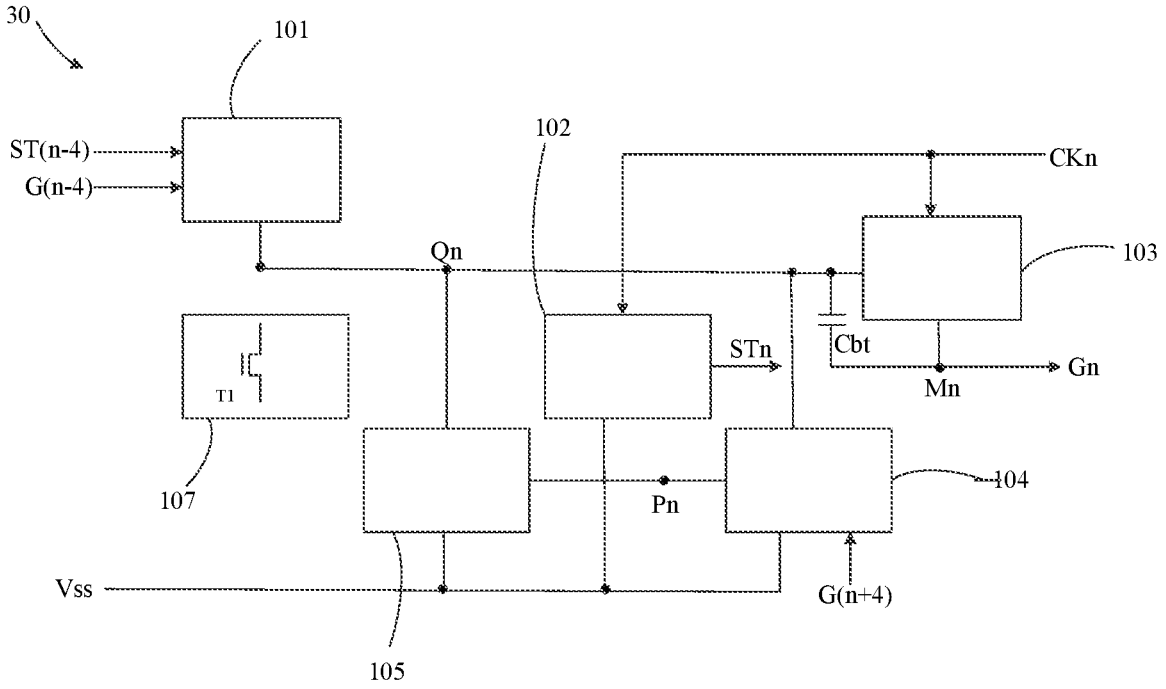
FIG. 5 is a second schematic structural diagram of a second GOA unit in a GOA circuit provided by an embodiment of the present application.

Referring to FIG. 5, FIG. 5 is a second schematic structural diagram of a second GOA unit in a GOA circuit provided by an embodiment of the present application. The virtual reset module 107 includes a virtual transistor T2. The virtual crystal T2 is disposed corresponding to the transistor T1. In some embodiments, in a source, a drain, and a gate of the virtual transistor T2, at least one electrode is unloaded. A structure of a film layer of the virtual transistor T2 is the same as that of the transistor T1. However, due to incompleteness of an access signal, the virtual transistor T2 cannot transmit the signal, it will not affect the circuit of the second GOA unit 30. At the same time, since the film structure of the virtual transistor T2 and the transistor T1 are the same, the process is further simplified, and the difference between the first GOA unit 20 and the second GOA unit 30 is reduced.

Figure 6:
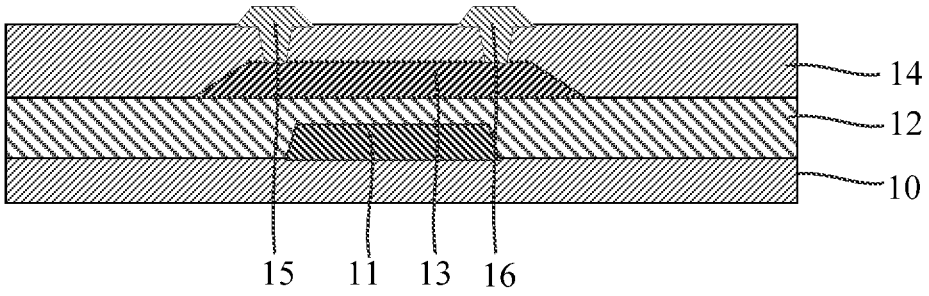
FIG. 6 is a schematic structural diagram of a transistor provided by an embodiment of the present application.

Referring to FIG. 6, FIG. 6 is a schematic structural diagram of a transistor provided by an embodiment of the present application. As shown in FIG. 6, the transistor T1 includes, but is not limited to, a gate 11, a first dielectric insulating layer 12, an active layer 13, a second dielectric insulating layer 14, a source 15, and a drain 16 stacked on the substrate 10. The specific structure of each film layer is conventional prior art, which will not be repeated in the present application. It should be noted that a bottom gate structure transistor is used as an example for introduction, but it cannot be understood as a limitation of the present application.

Figure 7:
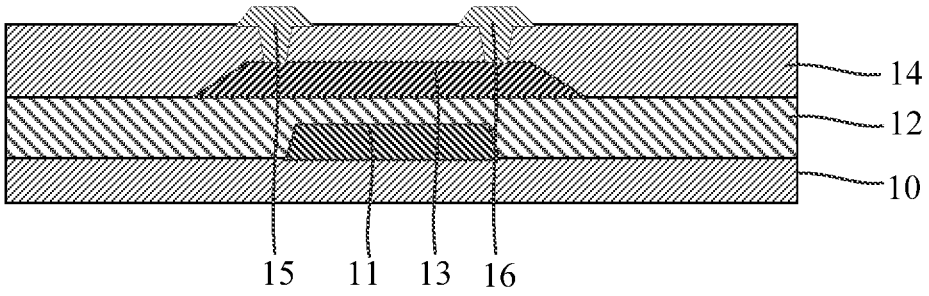
FIG. 7 is a schematic structural diagram of a virtual transistor provided by an embodiment of the present application.

In some embodiments, referring to FIG. 7, FIG. 7 is a schematic structural diagram of a virtual transistor provided by an embodiment of the present application. As shown in FIG. 7, the virtual transistor T2 is different from the transistor T1 in that the active layer 13 is not provided in the virtual transistor T2. That is, the virtual transistor T2 retains the same shape as the transistor T1, but cannot transmit signals. This setting can improve uniformity of metal etching in the process, and at the same time avoid the virtual transistor T2 from affecting the circuit of the second GOA unit 30, thereby improving stability of the GOA circuit.

Figure 8:
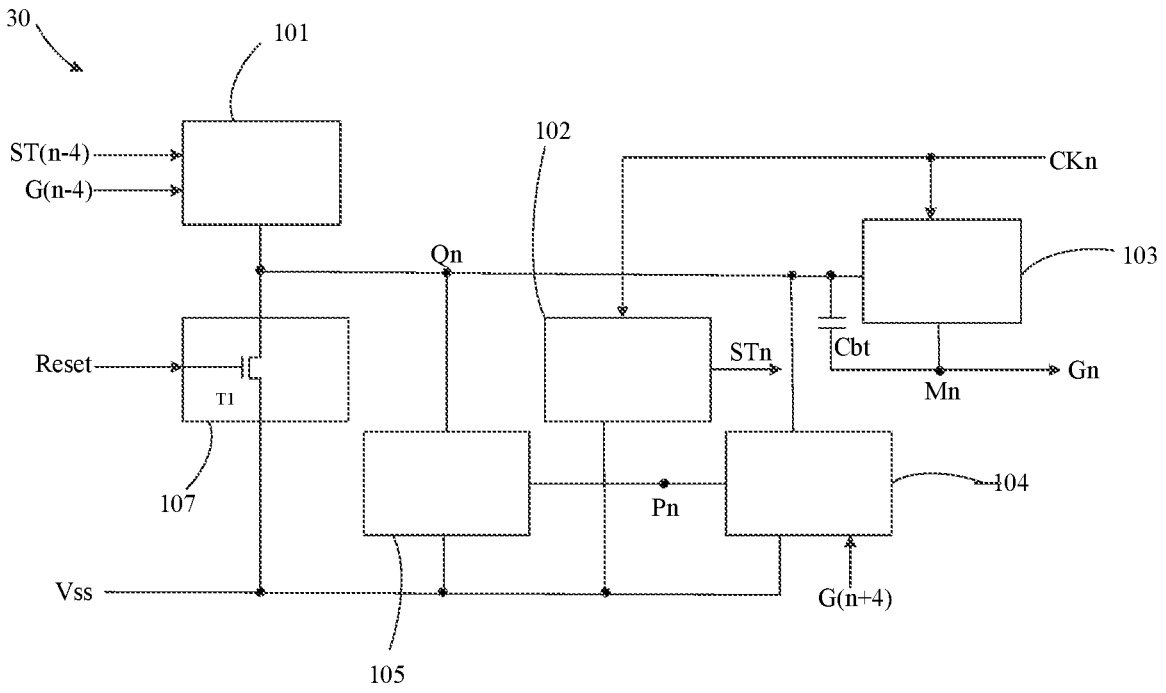
FIG. 8 is a third schematic structural diagram of a second GOA unit in a GOA circuit provided by an embodiment of the present application.

Further, referring to FIG. 8, the gate of the virtual transistor T2 without the active layer 13 is electrically connected to the control signal Reset. The source of the virtual transistor T2 is electrically connected to the low-potential signal Vss. The drain of the virtual transistor T2 is electrically connected to the first node Gn. This arrangement can further improve etching uniformity of each signal connection line between the first GOA unit 20 and the second GOA unit 30 on the basis that the virtual transistor T2 cannot perform signal transmission, thereby improving the consistency between the first GOA unit 20 and the second GOA unit 30.

In an embodiment of the present application, the virtual transistor T2 and the transistor T1 are made by the same process, which can simplify the process and increase the yield.

Further, in an embodiment of the present application, the virtual transistor T2 and the transistor T1 are thin film transistors of the same type. Therefore, multiple virtual transistors T2 and transistors T1 of the same type are formed in the GOA circuit, which simplifies the process and can effectively save productivity. However, the embodiment of the present application cannot be understood as limitations on the present application.

It should be noted that the specific circuit structure of the reset module 106 is not limited to include a transistor T1. The specific circuit structure of the virtual reset module 107 is not limited to include a virtual transistor T2. The specific circuit structures of the reset module 106 and the virtual reset module 107 can be set according to actual needs. On the basis of meeting the principles of the present application, this application does not limit this.

In an embodiment of the present application, the transistor in the GOA circuit may be a low temperature polysilicon thin film transistor, an oxide semiconductor thin film transistor, or an amorphous silicon thin film transistor. Specifically, it can be set according to actual requirements, which is not limited in the embodiments of the present application.

Figure 9:
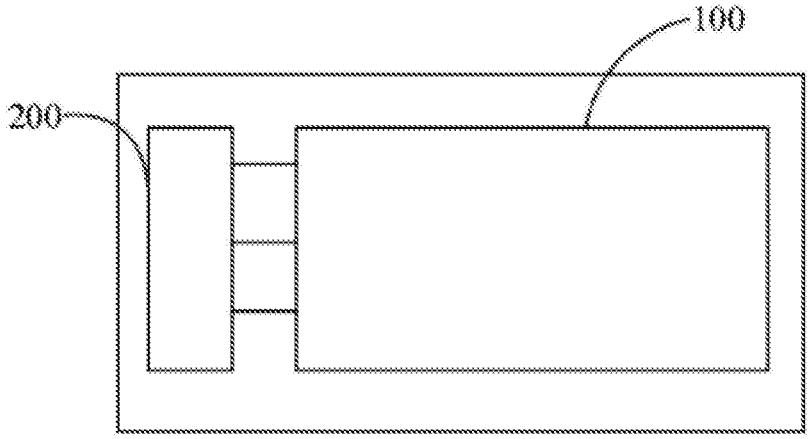
FIG. 9 is a schematic structural diagram of a display panel provided by an embodiment of the present application.

Referring to FIG. 9, FIG. 9 is a schematic structural diagram of a display panel provided by an embodiment of the present application. As shown in FIG. 9, the display panel includes a display area 100 and a GOA circuit 200 integrated on an edge of the display area 100. The structure and principle of the GOA circuit 200 is similar to the GOA circuit described above, and will not be repeated here. It should be noted that the display panel provided in an embodiment of the present application is described by using a single-sided driving method in which the GOA circuit 200 is provided on an side of the display area 100 as an example, but it cannot be understood as a limitation to the present application. In some embodiments, other driving methods such as double-sided driving may also be used according to the actual needs of the display panel, which is specifically limited in this application.

An embodiment of the present application provides a display panel. The display panel includes a GOA circuit 200. The GOA circuit 200 includes multiple GOA units arranged in cascade. The GOA units include a first GOA unit and a second GOA unit. By setting a virtual reset module in the second GOA unit, and the virtual reset module corresponding to the reset module in the first GOA unit, the difference between the first GOA unit and the second GOA unit is reduced, stability of the GOA circuit is improved, and an overall performance of the display panel is improved.

The embodiments of the present application have been described in detail above. This article uses specific examples to explain the principles and implementation of the present application. The descriptions of the above embodiments are only used to help understand the method and the core idea of the present application. At the same time, for those of ordinary skill in the art, according to ideas of the present application, there will be changes in the specific implementation manner and application scope. In summary, the content of this specification should not be understood as a limitation to the present application.

What is claimed is:

1. A gate driver on array (GOA) circuit, comprising:

a plurality of cascaded GOA units, wherein the GOA units comprise a first GOA unit and a second GOA unit, the first GOA unit and the second GOA unit are both provided with a first node;

wherein:

the first GOA unit comprises a reset module, the reset module is connected to a low-potential signal and a control signal and is electrically connected to the first node, and the reset module is configured to pull down a potential of the first node to a potential of the low-potential signal under control of the control signal;

the second GOA unit comprises a virtual reset module corresponding to the reset module;

wherein the reset module comprises a transistor, a gate of the transistor is electrically connected to the control signal, a source of the transistor is electrically connected to the low-potential signal, and a drain of the transistor is electrically connected to the first node; the virtual reset module comprises a virtual transistor, and the virtual transistor is disposed corresponding to the transistor.

2. The GOA circuit according to claim 1, wherein no active layer is provided in the virtual transistor.

3. The GOA circuit according to claim 2, wherein a gate of the virtual transistor is electrically connected to the control signal, a source of the virtual transistor is electrically connected to the low-potential signal, and a drain of the virtual transistor is electrically connected to the first node.

4. The GOA circuit according to claim 1, wherein at least one electrode is unloaded among a source, a drain, and a gate of the virtual transistor.

5. The GOA circuit according to claim 4, wherein the transistor and the virtual transistor are a same type of transistor.

6. The GOA circuit according to claim 5, wherein the transistor in the GOA circuit is a low temperature polysilicon thin film transistor, an oxide semiconductor thin film transistor, or an amorphous silicon thin film transistor.

7. The GOA circuit according to claim 1, wherein the virtual transistor and the transistor are made by a same process.

8. The GOA circuit according to claim 1, wherein the second GOA unit is connected to a start signal, and the start signal and the control signal are a same signal.

9. A display panel, comprising:

a GOA circuit comprising a plurality of cascaded GOA units, wherein the GOA units comprise a first GOA unit and a second GOA unit, the first GOA unit and the second GOA unit are both provided with a first node; wherein:

the first GOA unit comprises a reset module, the reset module is connected to a low-potential signal and a control signal and is electrically connected to the first node, and the reset module is configured to pull down a potential of the first node to a potential of the low-potential signal under control of the control signal;

the second GOA unit comprises a virtual reset module corresponding to the reset module;

wherein the reset module comprises a transistor, a gate of the transistor is electrically connected to the control signal, a source of the transistor is electrically connected to the low-potential signal, and a drain of the transistor is electrically connected to the first node; the virtual reset module comprises a virtual transistor, and the virtual transistor is disposed corresponding to the transistor.

10. The display panel according to claim 9, wherein no active layer is provided in the virtual transistor.

11. The display panel according to claim 10, wherein a gate of the virtual transistor is electrically connected to the control signal, a source of the virtual transistor is electrically connected to the low-potential signal, and a drain of the virtual transistor is electrically connected to the first node.

12. The display panel according to claim 9, wherein at least one electrode is unloaded among a source, a drain, and a gate of the virtual transistor.

13. The display panel according to claim 12, wherein the transistor and the virtual transistor are a same type of transistor.

14. The display panel according to claim 13, wherein the transistor in the GOA circuit is a low temperature polysilicon thin film transistor, an oxide semiconductor thin film transistor, or an amorphous silicon thin film transistor.

15. The display panel according to claim 9, wherein the virtual transistor and the transistor are made by a same process.

16. The display panel according to claim 9, wherein the second GOA unit is connected to a start signal, and the start signal and the control signal are a same signal.

* * * * *